US008941549B2

(12) United States Patent
Dong et al.

(10) Patent No.: US 8,941,549 B2
(45) Date of Patent: Jan. 27, 2015

(54) COMPACT FOUR-WAY TRANSDUCER FOR DUAL POLARIZATION COMMUNICATIONS SYSTEMS

(71) Applicant: Tongyu Communication Inc., Zhongshan (CN)

(72) Inventors: Junwei Dong, Zhongshan (CN); Zhonglin Wu, Zhongshan (CN); Guohui Xiong, Zhongshan (CN)

(73) Assignee: Tongyu Communication Inc., Zhongshan (CN)

( * ) Notice: Subject to any disclaimer, the term of this patent is extended or adjusted under 35 U.S.C. 154(b) by 209 days.

(21) Appl. No.: 13/790,963

(22) Filed: Mar. 8, 2013

(65) Prior Publication Data

US 2013/0265204 A1 Oct. 10, 2013

Related U.S. Application Data

(60) Provisional application No. 61/620,473, filed on Apr. 5, 2012.

(30) Foreign Application Priority Data

Feb. 5, 2013 (CN) ..... 2013 1 0046691

(51) Int. Cl.

| | |
|---|---|
| ***H01Q 15/24*** | (2006.01) |
| ***H01P 5/18*** | (2006.01) |
| ***H01P 5/16*** | (2006.01) |

(52) U.S. Cl.

CPC ..... *H01P 5/18* (2013.01); *H01Q 15/24* (2013.01); *H01P 5/16* (2013.01)

USPC ..... 343/756; 343/772

(58) Field of Classification Search

CPC ..... H01Q 15/24; H01P 5/18; H01P 5/16

USPC ..... 343/772, 786, 756

See application file for complete search history.

(56) References Cited

U.S. PATENT DOCUMENTS

| | | | | |
|---|---|---|---|---|
| 3,731,235 | A * | 5/1973 | Ditullio et al. | 333/135 |
| 4,473,828 | A * | 9/1984 | Morz et al. | 343/786 |
| 5,617,108 | A * | 4/1997 | Silinsky et al. | 343/786 |
| 6,621,375 | B2 * | 9/2003 | Vezmar et al. | 333/125 |
| 7,180,459 | B2 * | 2/2007 | Balaji et al. | 343/786 |
| 7,408,427 | B1 | 8/2008 | Lee-Yow et al. | |
| 2010/0149058 | A1 | 6/2010 | Bosshard et al. | |

* cited by examiner

*Primary Examiner* — Hoanganh Le

(74) *Attorney, Agent, or Firm* — Hamre, Schumann, Mueller & Larson, P.C.

(57) ABSTRACT

A compact four-way transducer (FWT) is provided for a microwave communications system. The compact FWT is a compact assembly that is configured to process microwave signals in dual-polarization antenna feeds and to provide single polarized signals for four communications channels. The compact FWT includes four terminals facing different directions at one end for receiving/sending single polarized signals, and a terminal at an opposite end for receiving/sending dual polarized signals.

21 Claims, 10 Drawing Sheets

| Component Types | Example 1 | Example 2 |
|---|---|---|
| 90° E - Bend | | |
| 90° H - Bend | | |
| Through | | |
| Directional Coupler | a b 5111 5112 c d | |
| Polarization Switcher | 512 512 | |
| Othomode Transducer | | |
| Matching Section | | |

FIG.5

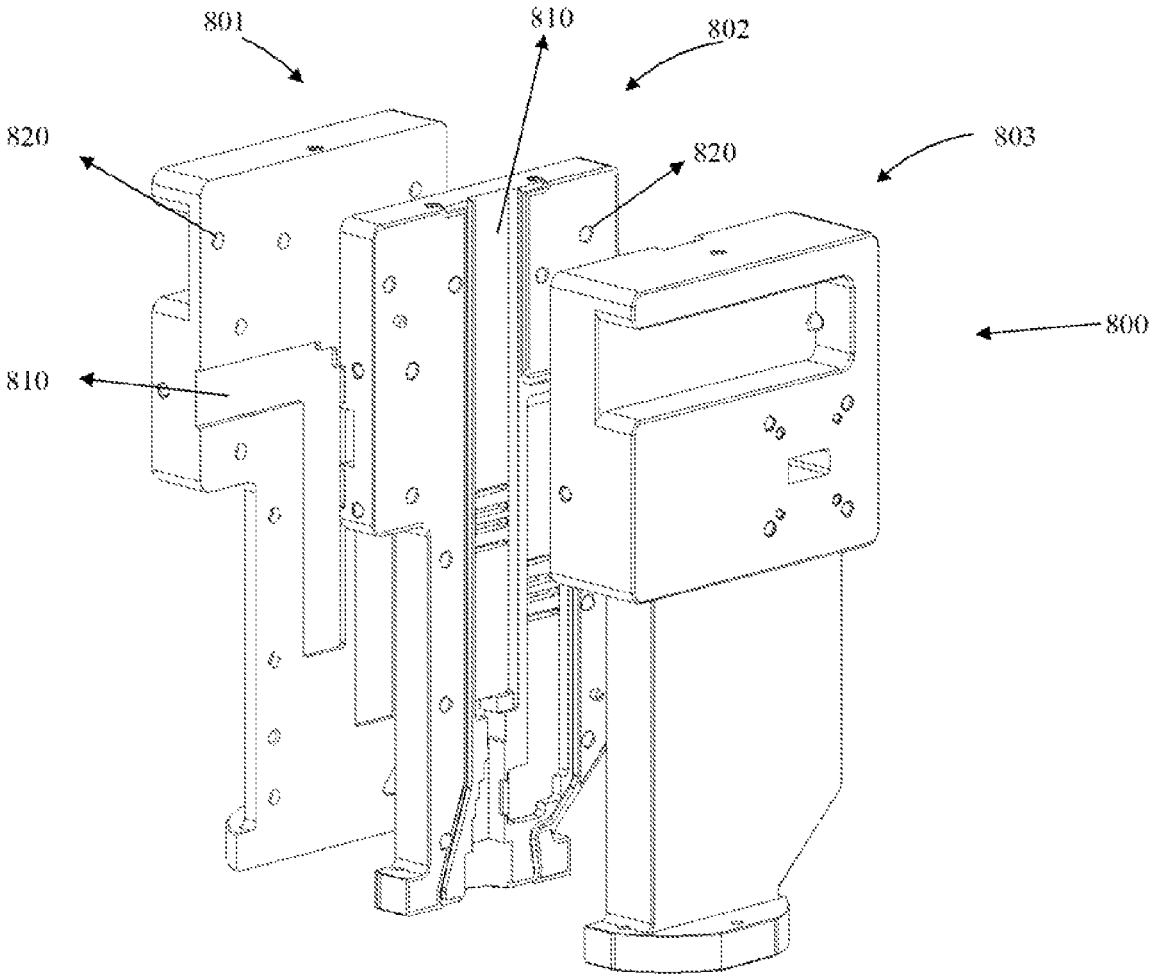
FIG..8a

COMPACT FOUR-WAY TRANSDUCER FOR DUAL POLARIZATION COMMUNICATIONS SYSTEMS

FIELD OF TECHNOLOGY

The embodiments disclosed herein relate generally to a microwave communications system. More specifically, the embodiments describe a compact transducer for a microwave communications system.

BACKGROUND

A wave guide and/or cavity type of structures are widely used in a microwave communications system for receiving and/or transmitting microwave signals between a microwave antenna and a communications unit such as, for example, a filter, a diplexer, an amplifier, etc.

SUMMARY

The embodiments described herein relate to a microwave communications system. In particular, the embodiments describe a compact transducer for a microwave communications system.

The compact transducer described herein can be a compact assembly that is configured to process microwave signals in dual-polarization antenna feeds and provide single polarized signals for four communications channels. The compact transducer described herein can yield higher reliability for broadband wireless communications signals by channel duplication of orthogonally polarized electromagnetic waves.

In one embodiment, a compact assembly for a microwave communications system includes a first input/output end including four terminals each configured to send/receive single polarized electromagnetic signals, and a second input/output end including a terminal configured to send/receive an electromagnetic signal having dual polarized modes. The compact assembly extends from the first input/output end to the second input/output end along a longitudinal direction. A first directional coupler has two adjacent ports at one end. First and second of the terminals of the first input/output end are connected to the adjacent ports of the first directional coupler via respective transmission lines. A second directional coupler has two adjacent ports at one end. Third and fourth of the terminals of the first input/output end are connected to the adjacent ports of the second directional coupler via respective transmission lines. An orthomode transducer (OMT) includes first and second ports each configured to send/receive an electromagnetic signal having a single polarization mode to/from the first or second directional coupler, and a third port configured to send/receive the electromagnetic signal having dual polarized modes to/from the terminal of the second input/output end. A polarization switcher connects one of the first and second directional couplers to one of the first and second ports of the OMT. The polarization switcher is configured to switch a polarization of one of the electromagnetic signals having a single polarization mode that is transmitted therethrough. A through transmission line connects the other of the first and second directional couplers to the other of the first and second ports of the OMT. The through transmission line is configured to transmit energy without switching a polarization of the other of the electromagnetic signals having a single polarization mode that is transmitted therethrough.

BRIEF DESCRIPTION OF THE DRAWINGS

Referring now to the drawings in which like reference numbers represent corresponding parts throughout.

FIG. 5 illustrates internal structures of exemplary components of a compact four-way transducer, according to one embodiment.

FIG. 8*a* illustrates an exploded, side perspective view of a four-way transducer (FWT), according to one embodiment.

DETAILED DESCRIPTION

The embodiments described herein relate to a microwave communications system. In particular, the embodiments describe a compact transducer for a microwave communications system.

In one embodiment, the compact transducer described herein can be a compact assembly that is configured to process microwave signals in dual-polarization antenna feeds and provide single polarized signals for four communications channels.

Figure 1:
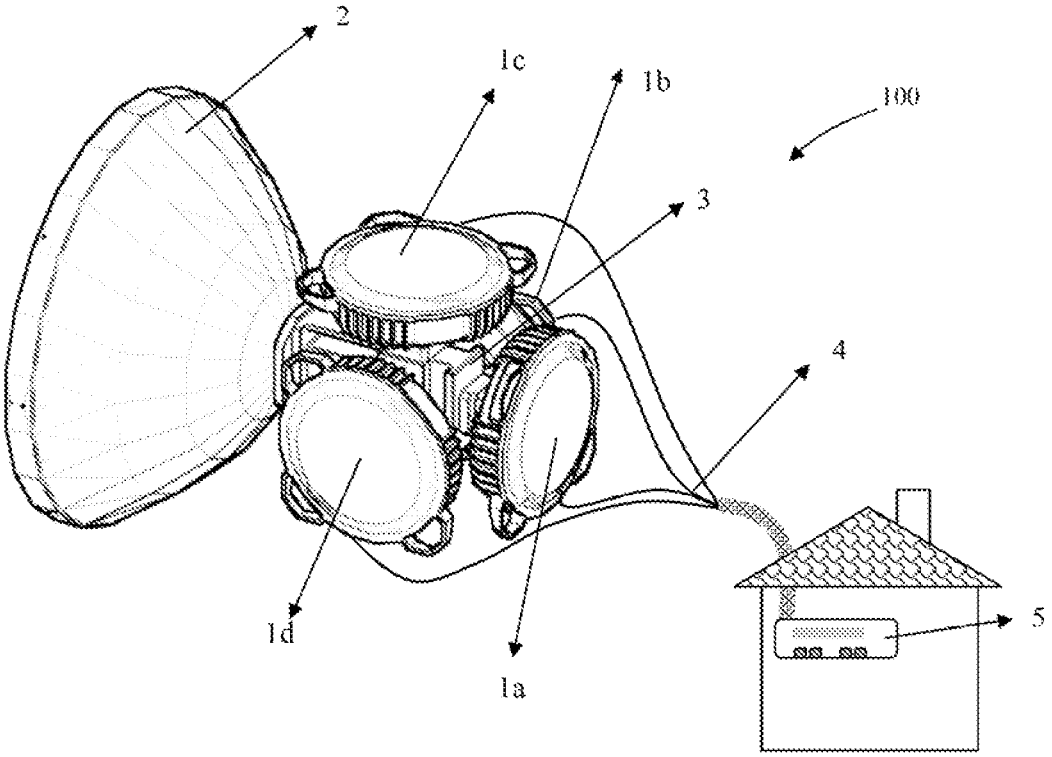
FIG. 1 illustrates a perspective view of a four-channel microwave communications system, according to one embodiment.
Figure 2:
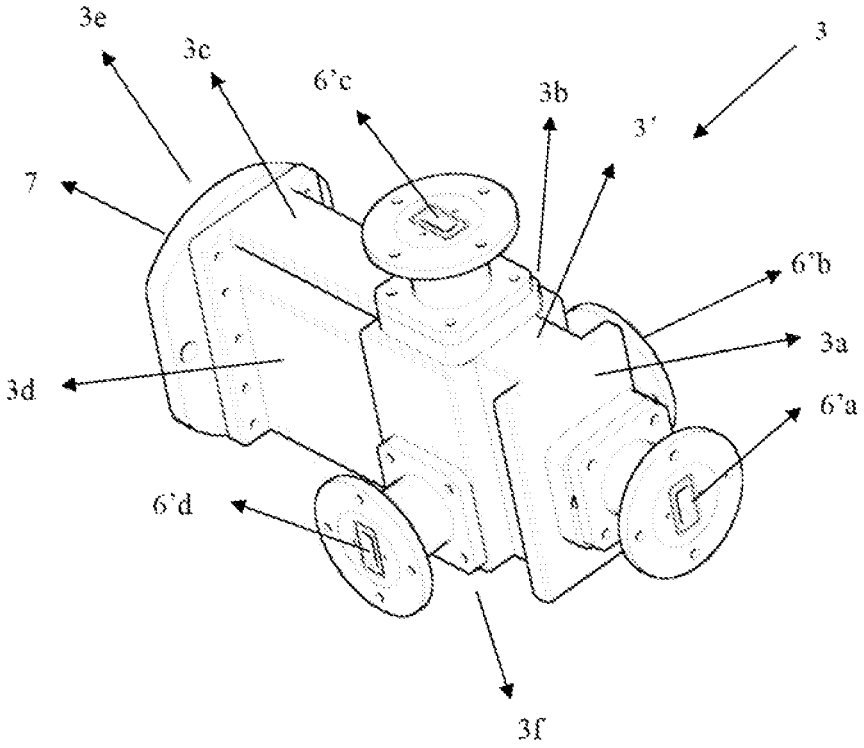
FIG. 2 illustrates a perspective side view of a compact four-way transducer (FWT) for a dual polarization communications system, according to one embodiment.

FIG. 1 shows a perspective view of a microwave communications system 100 that includes an integrated four-way transducer (FWT) 3. The FWT 3 is also shown in FIG. 2. The FWT 3 includes a FWT housing 3' having a generally rectangular or cylindrical shape. The FWT 3 has end faces 3*a* and 3*e* opposite to each other, side faces 3*b* and 3*d* opposite to each other, and an upper face 3*c* and a bottom face 3*f* opposite to each other. It is to be understood that the FWT 3 can be other suitable shapes and the respective faces thereof can be arranged otherwise.

The microwave communications system 100 further includes four outdoor units (ODUs) 1*a-d*, a microwave antenna (MWA) 2, four transmission lines 4, and an indoor unit (IDU) 5. The ODUs 1*a-d* are disposed on the respective faces 3*a-d* of the FWT 3 and attached to the FWT 3 via connection terminals 6'*a-d*, respectively. The MWA 2 is disposed on the end face 3*e* and is attached to the FWT 3 via a connection terminal 7. The outdoor units 1*a-d* are connected to the indoor unit 5 via the transmission lines 4.

In some embodiments, the integrated four-way transducer (FWT) 3 can be used in any application to connect communications units (e.g., the outdoor units 1*a-d* of FIG. 1) via the connection terminals 6'*a-d*. The communication units can include, for example, filters, diplexers, amplifiers, etc. The connection terminal 7 can be adjusted to attach any communications component that supports dual polarized modes such as, for example, polarizer, circular delay line, and/or any other type of radiation elements.

In one embodiment, the communications system 100 can be a 4G Long Term Evolution (LTE) communications channel. In another embodiment, the communications system 100 can be a 3G channel for voice, video, internet duplex communications, etc.

Figure 3:
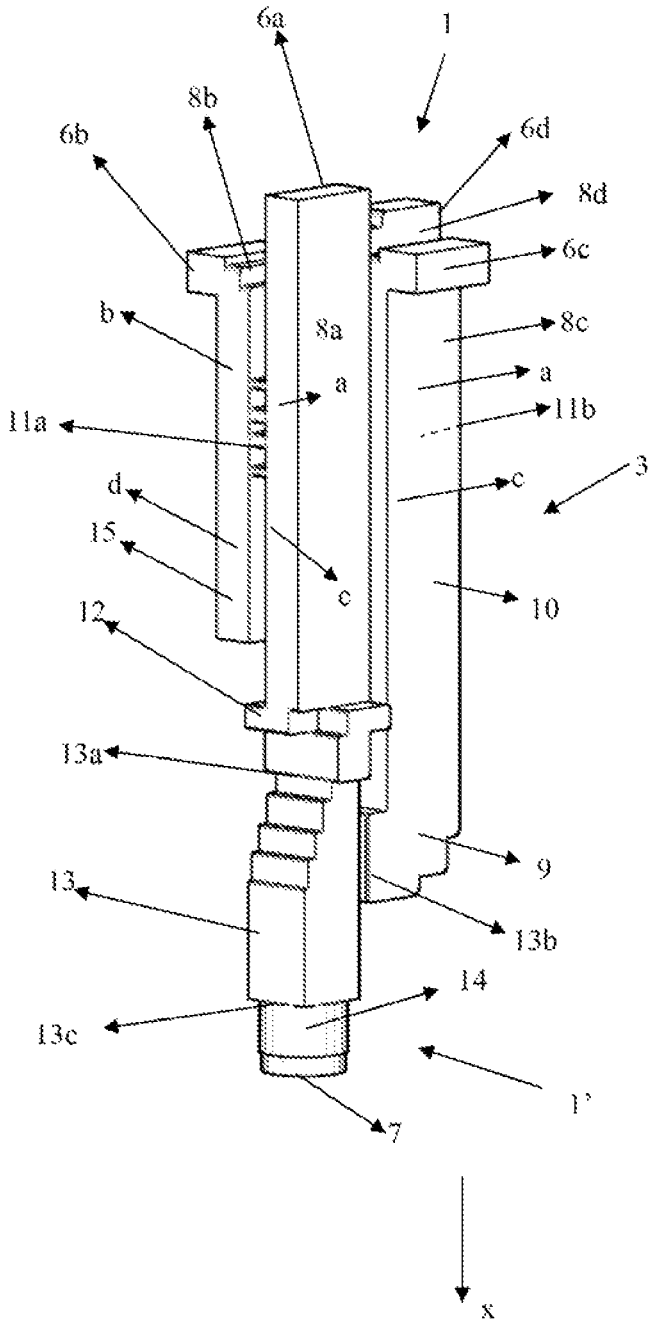
FIG. 3 illustrates a perspective side view of the internal structure of the compact four-way transducer of FIG. 2, according to one embodiment.

FIG. 3 illustrates an internal structure of the FWT 3 of FIG. 2, according to one embodiment. The housing 3' of FIG. 2 defines waveguide and/or cavity structures therein. FIG. 3 shows a solid perspective view of the waveguide and/or cavity structures defined by the housing 3', according to one embodiment. The FWT 3 includes four terminals 6*a-d* at a first input/output end 1. The terminals 5*a-d* correspond to the connection terminals 6'*a-d* of FIG. 2, respectively. The FWT 3 further includes a terminal 7 at a second input/output end 1' opposite to the first end 1. The terminal 7 corresponds to the connection terminal 7' of FIG. 2. The FWT 3 extends along a longitudinal axis X from the first input/output end 1 to the second input/output end 1'.

The FWT 3 includes four transmission lines 8*a-d* respectively connected to the terminals 6*a-d*. In the embodiment shown in FIG. 3, the transmission line 8*a* connected to the terminal 6*a* is a through transmission line. The transmission line 8*b* connected to the terminal 6*b* is an E-bend. The transmission line 8*c* connected to the terminal 6*b* is an E-bend. The transmission line 8*d* connected to the terminal 6*b* is an H-bend.

Exemplary through transmission lines, E-bends, and H-bends are illustrated in FIG. 5. A through transmission line allows energy to go back and forth without any discontinuities. As shown in FIG. 3, the transmission line 6*a* is a rectangular waveguide. It is to be understood that the transmission line can have a circular cross shape or other suitable shapes. An E-bend can be a rectangular waveguide having a bending structure for bending the transmission direction of the electrical field of an electromagnetic wave transmitted therethrough. As shown in FIGS. 3 and 5, the E-bends can include a 90° bending structure for bending the electrical field direction by 90°. For a propagating electromagnetic wave, the electrical field thereof is normal to the magnetic field thereof. In a 90° E-bend, the magnetic field direction may not be changed. An H-bend is configured to bend the direction of the magnetic field of an electromagnetic wave, but not the electrical field thereof. It is to be understood that there are many ways of designing an E-bend or an H-bend.

The terminals 6*a* and 6*b* are adjacent to each other and connected to two ports a and b of a first directional coupler 11*a*, via the transmission lines 8*a* and 8*b*, respectively. The terminals 6*c* and 6*d* are adjacent to each other and connected to two ports of a second directional coupler 11*b* (only one port a is shown in FIG. 3), via the transmission lines 8*a* and 8*b*, respectively. As shown in FIG. 5, the first or second directional coupler 11*a* or 11*b* includes two coupled transmission lines 5111 and 5112 each having two opposite ports (e.g., a and c, or b and d). The transmission lines 5111 and 5112 extend in parallel along the longitudinal axis X and have a generally rectangular cross shape. The transmission lines 5111 and 5112 are disposed adjacent to each other such that energy passing through one is coupled to the other.

The directional coupler 11*a* or 11*b* is a four port passive network that allows energy coming from one input port (e.g., the port d) to split into two predetermined parts at the opposite two ports (e.g., the ports a and b). The energy splits can be, for example, 3 dB, 6 dB, 10 dB, etc., depending on various communications systems.

The port c of the first directional coupler 11*a* is connected to a port 13*a* of an orthomode transducer (OMT) 13 via a polarization switch 12. The polarization switch 12 is configured to change the polarization of an electromagnetic field transmitted from one end to the other end thereof, as indicated by arrows 512 in FIG. 5.

The port c of the second directional coupler 11*b* is connected to a port 13*b* of the OMT 13 via a through transmission 10 and an H-bend 9. The through transmission 10 is configured to transmit energy therethrough without discontinuities. The H-bend 9 is configured to bend the direction of magnetic field of a microwave signal transmitted therethrough.

The ports d of the first and second directional couplers 11*a-b* each are connected to a load 15 (only the load 15 connected to the directional coupler 11*a* is visible). The loads 15 each are configured to absorb extra energy coupled to the respective port d. In one embodiment, when a single polarized electromagnetic field is fed into the terminal 6*a*, a portion of the energy, e.g., 6 dB, can be transferred to the polarization switcher 12, while the rest of the energy is coupled and absorbed by the load 15.

The OMT 13 includes the ports 13*a* and 13*b* connected to the first and second directional coupler 11*a* and 11*b*, respectively, and a third port 13*c* connected to the terminal 7 at the second end 1', via a matching section 14. The OMT 13 can combine two sources of energies (e.g., from the ports 13*a* and 13*b*) whose polarizations are normal to each other into a single transmission line (e.g., connected to the port 13*c*) that allows for dual polarizations. Vice versa, the OMT 13 can split two orthogonal polarizations in a single channel (e.g., from the port 13*c*) into two separated channels (e.g., to the ports 13*a* and 13*b*, respectively). The ports 13*a* and 13*b* are configured to support a single electromagnetic mode. As shown in FIGS. 3 and 5, the ports 13*a* and 13*b* each have a rectangular cross shape. The port 13*c* has a symmetric structure that is configured to support dual polarizations. As shown in FIGS. 3 and 5, the port 13*c* has a square or circular cross shape. It is to be understood that the ports 13*a-c* of the OMT 13 can have other suitable cross shapes configured to support respective signals.

The matching section 14 connects to the port 13*c* of the OMT 13 at one end thereof and connects to the terminal 7 at the other end. The matching section 14 is configured to do impedance matching between the port 13*c* of the OMT 13 and a device connected to the terminal 7. In one embodiment, the terminal 7 accommodated to the antenna 2 can have a circular port with a diameter d1. The port 13*c* of the OMT 13 may have a diameter different from d1. The matching section 14 is configured to adapt the OMT 13 to the required dimension d1. It is to be understood that the OMT 13 can have various configurations to achieve the matching and the matching section 14 is optional.

In the embodiment shown in FIGS. 1-3, the terminals 6*a-d* (or 6'*a-d*) are disposed on the top, left, right, front or back faces of the FWT 3. Such arrangements can avoid connecting one device to the bottom face of the FWT 3. This can reduce the risk of corrosion due to water collection on the device. In the real application, the overall exterior structure of the FWT 3 could be, for example, cylindrical, rectangular shapes, etc.

Figure 4:
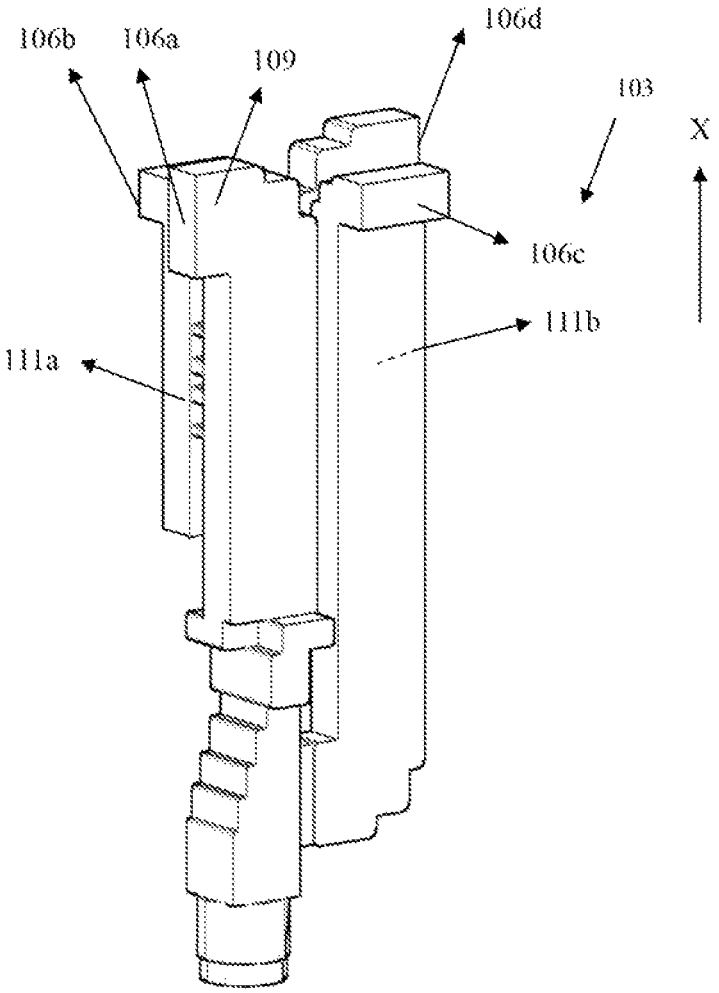
FIG. 4 illustrates a perspective side view of an internal structure of a compact four-way transducer, according to another embodiment.

FIG. 4 illustrates an internal structure of a FWT 103, according to another embodiment. The FWT 103 includes terminals 106*a-d* each facing a respective direction generally perpendicular to the longitudinal axis X. The FWT 103 further includes first and second directional couplers 111*a* and 111*b* each having ports connected to the terminals 106*a-d* via an E-bend or H-bend 109.

It is to be understood that the geometric locations of the terminals of the FWT 3 or 103 can be adjusted to face any directions.

Figure 6:
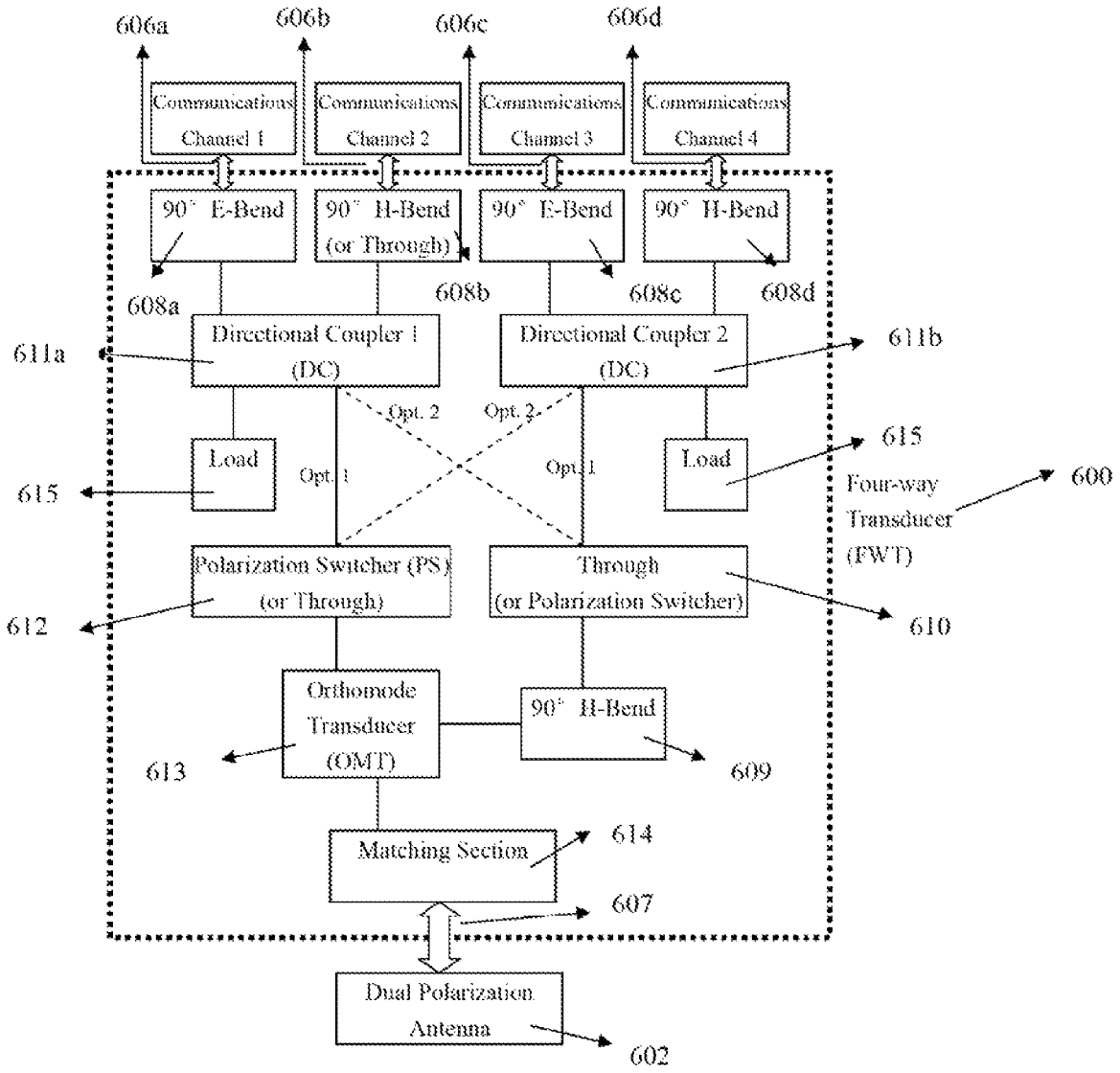
FIG. 6 illustrates a block diagram of a compact four-way transduce, according to one embodiment.

FIG. 6 shows a block diagram of a FWT 600, according to one embodiment. The FWT 600 includes terminals 606*a-d* respectively connected to communications channels 1-4. The terminals 606*a* and 606*b* are connected to a first directional coupler 611*a*, via an E-bend 608*a* and an H-bend 608*b*, respectively. The terminals 606*c* and 606*d* are connected to a second directional coupler 611*b*, via an E-bend 608*c* and an H-bend 608*d*. In one embodiment, one of the E-bend or H-bend 608*a-d* can be replaced by a through transmission line. In one embodiment, one of the H-bends 606*b* and 606*d* can be replaced by a through transmission line.

The directional couplers 611*a-b* each have a port connected to a load 615 and an adjacent port connected to a polarization switcher 612 or a through transmission line 610. In one embodiment, the first directional coupler 611*a* can be connected to the polarization switcher 612 and the second directional coupler 611*b* can be connected to through transmission line 610. In another embodiment, the second directional coupler 611*b* can be connected to the polarization switcher 612 and the first directional coupler 611*a* can be connected to through transmission line 610.

The polarization switch 612 is connected to a first port of an OMT 613. The through transmission line 610 is connected to a second port of the OMT 613, via an H-bend 609. The OMT 613 includes a third port connected to a terminal 607, via an optional matching section 614. The terminal 607 can be connected to a dual polarization antenna 602.

The above components (e.g., 608*a-d*, 611*a-b*, 615, 610, 612, 609, 613, and 614) of the FWT 600 can include, but not limited to, the respective exemplary components as illustrated in FIG. 5.

In one embodiment, the directional couplers 611*a* and/or 611*b* can be symmetrically designed as, for example, a 3-dB hybrid. In another embodiment, the directional couplers 611*a* and/or 611*b* can be asymmetrically designed as, for example, 6 dB, 10 dB, etc.

In some embodiments, adjacent two terminals (e.g., the terminals 606*a* and 606*b*, or the terminals 606*c* and 606*d*) that are connected to the directional coupler 611*a* or 611*b* can have a high isolation of −25 dB or better. One of the two adjacent terminals 606*a*) can serve for a "hot" status (i.e., being active in operation), and the other one (e.g., 606*b*) can serve for a "stand" status (i.e., operation at stand). Similarly, the adjacent terminals 606*c* and 606*d* can serve for a "hot" or "stand" status, respectively. That is, instantly, one terminal of 606*a* and 606*b*, and one terminal out of 606*c* and 606*d*, can simultaneously serve for the "hot" status or being active in operation. This configuration allows for one duplication device for each of the polarization communications channels 1-4, offering much more robust, reliable and efficient link services than a single channel configuration.

In some embodiments, when single polarized electromagnetic field is fed into one of the terminals (e.g., 606*a*), a portion of its energy (e.g., 6 dB) can be transferred to the polarization switcher 612, while the rest of the energy can be coupled and absorbed by the dummy load 615. Similar operation can be applied to the energy fed into the terminal 606*c*.

In some embodiments, the polarization switcher 612 can convert the polarized energy coming from the terminal 606*a* into a first electromagnetic field having a first polarization direction (e.g., a front-to-back direction) and input the field to the first port of the OMT 613. The polarized energy (e.g., 6 dB) from the terminal 606*c* can be fed into the H-bend 609, and consequently change to a second electromagnetic field having a second polarization direction (e.g., a left-to-right direction) and input to the second port of the OMT 613. The first polarization direction of the first electromagnetic field and the second polarization direction of the second electromagnetic field are orthogonal to each other. The OMT 613 can combine the orthogonal-polarized energies into dual polarized fields. Then, the dual polarized fields can be output from the third port of the OMT 613 to the matching section 614. The matching section 614 can further output the dual polarized fields or energy to the terminal 607 and to the dual polarization antenna 602 connected to the terminal 607.

In some embodiments, the OMT 613 can split a dual polarized field having two orthogonal polarizations in a single channel into two single polarized fields having orthogonal polarization directions. One of the two single polarized fields can be further power divided by the directional coupler 611*a* into first two individual signals. The other of the two single polarized fields can be further power divided by the directional coupler 611*b* into second two individual signals. The first and second individual signals can be transmitted to the communications channels 1-4, respectively.

In some embodiments, two orthogonal electromagnetic signals can operate independently of each other. One of the orthogonal electromagnetic signals can be at a receiving mode and the other can be at a transmitting mode. As discussed above, adjacent two terminals (e.g., the terminals 606*a* and 606*b*, or the terminals 606*c* and 606*d*) can have a relatively high isolation (e.g., −25 dB or better). This allows the two orthogonal electromagnetic signals to be energized by the terminal 602 or excited by the communications channel 1-4. This also allows the adjacent communications channels (1 and 2, or 3 and 4) that connected to the same directional coupler (e.g., 611*a* or 611*b*) to receive/send signals having different transmitting frequencies simultaneously.

Figure 7A:
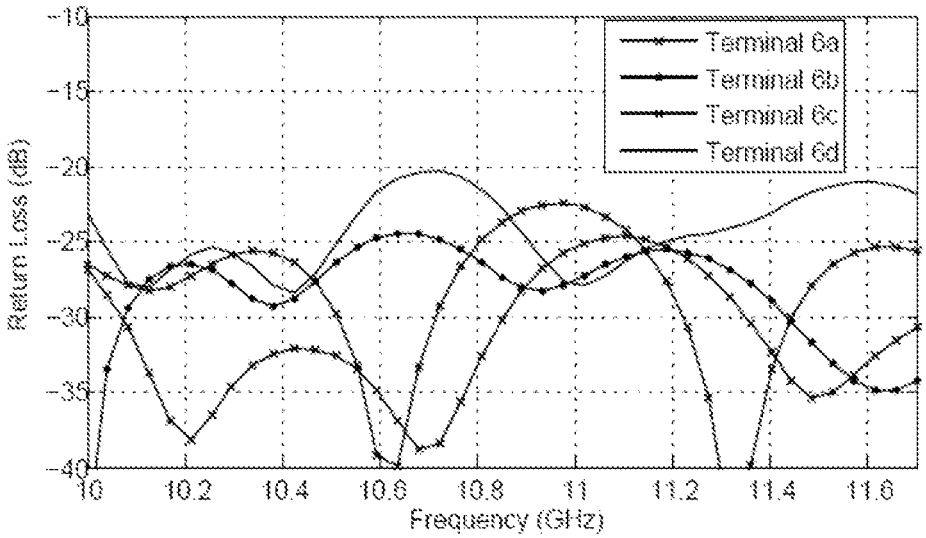
FIG. 7*a* illustrates a performance of the compact four-way transducer of FIG. 2.
Figure 7B:
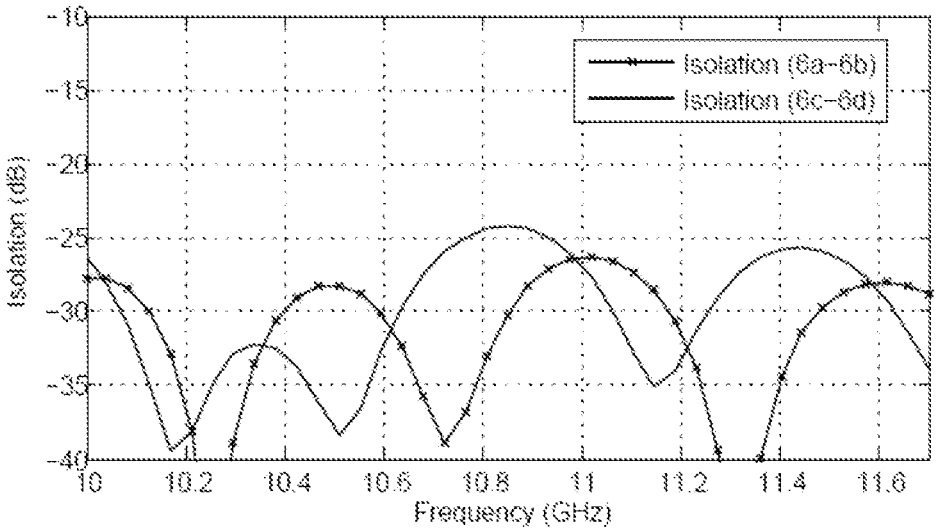
FIG. 7*b* illustrates another performance of the compact four-way transducer of FIG. 2.
Figure 7C:
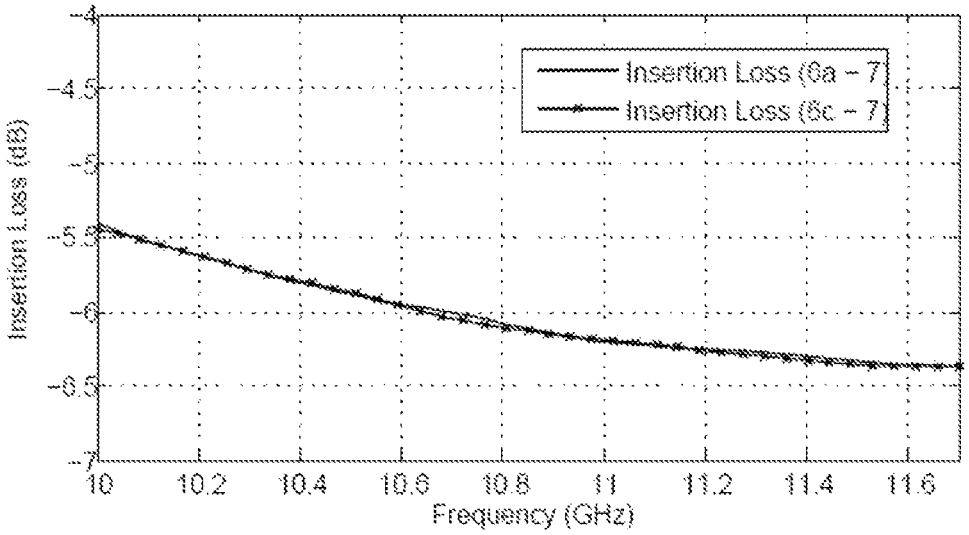
FIG. 7*c* illustrates another performance of the compact four-way transducer of FIG. 2.

FIGS. 7*a-c* show typical performance of a FWT described herein. FIG. 7*a* shows that return loss of all four terminals 6*a-d* less than −20 dB has been achieved across 16% operation bandwidth. FIG. 6 shows that the isolation between adjacent ports of the directional couplers is less than −24 dB, and FIG. 7 shows that the 6 dB insertion loss between the primary input terminals 6*a*, 6*c* and terminal 7 is achievable with a perturbation of ±0.5 dB.

The FWT described herein can have a size according to an operation frequency bandwidth of, e.g., about 5 GHz to about 150 GHz. The FWT can be made of materials such as, for example, aluminum, stainless still, rare metal coated plastics, etc. In one embodiment, the FWT is made of aluminum alloy. The FWT can be manufactured by a process of Computer Numerical Control (CNC) machining, using laser cutting, lathe tools, etc.

Figure 8B:
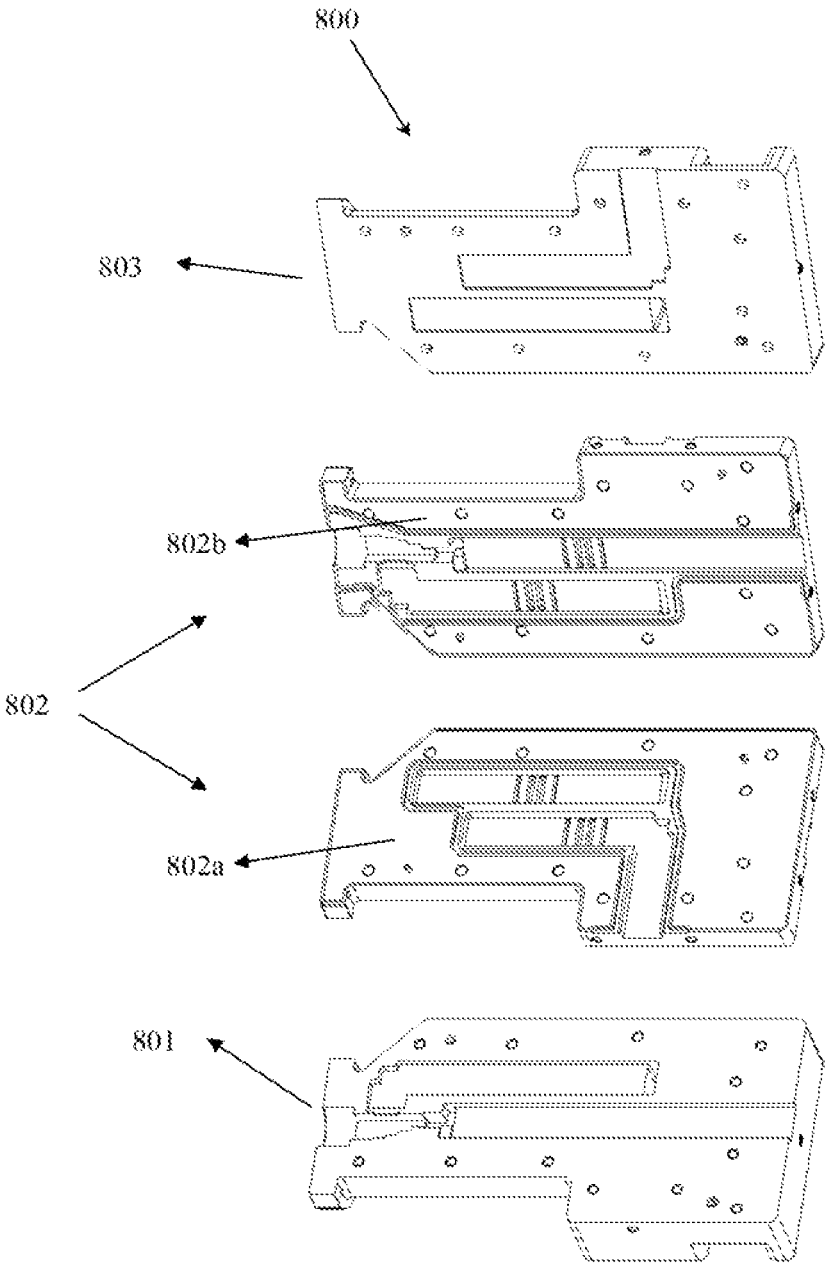
FIG. 8*b* illustrates another exploded, side perspective view of the FWT of FIG. 8*a* with two opposite major surfaces of the piece 802 shown.

In one embodiment, the FWT 3 of FIGS. 2 and 3 can be manufactured by, e.g., a CNC machining, after having the structure cut into three pieces. FIGS. 8*a-b* illustrates exploded side perspective views of a FWT 800 with three pieces 801, 802 and 803 to be assembled. The three pieces 801, 802 and 803 are rectangular blocks that define cavities or waveguides 810 on respective major surface(s) (e.g., 802*a* and 802*b* shown in FIG. 8*b*) to form various components. The formed components can include, for example, one or more E-bends, one or more H-bends, one or more through transmission lines, two directional couplers, a polarization switcher, an othomode transducer (OMT), and/or a matching section, as shown in FIG. 5. The three pieces 801, 802 and 803 further includes holes 820 through which the three pieces 801, 802 and 803 can be connected by e.g., bolts and nuts. Upon assembled, the components 810 defined by the three pieces 801, 802 and 803 can be connected in a manner as shown in FIGS. 2-4 and perform as a FWT.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

The invention claimed is:

1. A compact assembly for a microwave communications system, comprising:

a first input/output end including four terminals each configured to send/receive single polarized electromagnetic signals;

a second input/output end including a terminal configured to send/receive an electromagnetic signal having dual polarized modes, the compact assembly extending from the first input/output end to the second input/output end along a longitudinal direction;

a first directional coupler having two adjacent ports at one end, first and second of the terminals of the first input/output end being connected to the adjacent ports of the first directional coupler via respective transmission lines;

a second directional coupler having two adjacent ports at one end, third and fourth of the terminals of the first input/output end being connected to the adjacent ports of the second directional coupler via respective transmission lines;

an orthomode transducer (OMT), the OMT including first and second ports each configured to send/receive an electromagnetic signal having a single polarization mode to/from the first or second directional coupler, and a third port configured to send/receive the electromagnetic signal having dual polarized modes to/from the terminal of the second input/output end;

a polarization switcher connecting one of the first and second directional couplers to one of the first and second ports of the OMT, the polarization switcher configured to switch a polarization of one of the electromagnetic signals having a single polarization mode that is transmitted therethrough; and a through transmission line connecting the other of the first and second directional couplers to the other of the first and second ports of the OMT, the through transmission line configured to transmit energy without switching a polarization of the other of the electromagnetic signals having a single polarization mode that is transmitted therethrough.

2. The compact assembly of claim 1, wherein the transmission lines connecting the terminals of the first input/output end to the ports of the first and second directional couplers are adjacent to each other.

3. The compact assembly of claim 2, wherein the transmission lines include at least one through transmission line configured to transmit energy without discontinuity, at least one E-bend configured to bend a transmission direction of the electrical field of an electromagnetic signal transmitted therethrough, and at least one H-bend configured to bend a transmission direction of the magnetic field of an electromagnetic signal transmitted therethrough.

4. The compact assembly of claim 1, further comprising a H-bend configured to connect the polarization switch or the through transmission line to the first or second port of the OMT, H-bend being configured to bend a transmission direction of the magnetic field of an electromagnetic signal transmitted therethrough.

5. The compact assembly of claim 1, further comprising a matching section connecting the third port of the OMT and the terminal of the first input/output end.

6. The compact assembly of the claim 1, wherein the first and second terminals connected to the adjacent ports of the first directional coupler achieve an isolation of about −25 dB or better.

7. The compact assembly of the claim 1, wherein the third and fourth terminals connected to the adjacent ports of the second directional coupler achieve an isolation of about −25 dB or better.

8. The compact assembly of the claim 1, wherein the first and second directional couplers each includes two coupled transmission lines extending along the longitudinal direction, the two coupled transmission lines have the adjacent ports positioned at a first end thereof and additional two adjacent ports positioned at a second end thereof opposite the first end.

9. The compact assembly of claim 8, wherein one of the additional two adjacent ports is connected to a dummy load for absorbing a portion of the energy of the electromagnetic signals having a single polarization mode, and the other of the additional two adjacent ports is connected to the polarization switcher or the through transmission line.

10. The compact assembly of claim 1, wherein the first and second terminals at the first input/output end face different directions that are generally perpendicular to the longitudinal direction.

11. The compact assembly of claim 10, wherein the first and second terminals each has a generally rectangular shape orthogonal to each other.

12. The compact assembly of claim 1, wherein the third and fourth terminals at the second input/output end face different directions that are generally perpendicular to the longitudinal direction.

13. The compact assembly of claim 12, wherein the third and fourth terminals each has a generally rectangular shape orthogonal to each other.

14. The compact assembly of claim 1, wherein the terminal of the second input/output end faces a first direction generally parallel to the longitudinal direction of the compact assembly, one of the four terminals faces a direction opposite to the first direction, the rest of the four terminals face different directions that are generally perpendicular to the longitudinal direction.

15. The compact assembly of claim 1, wherein the compact assembly has an upper side, a down side opposite the upper side, a left side, a right side opposite the left side, a front side, a back side opposite the front side, the front and back sides face or face away from the longitudinal direction, the terminal of the second input/output end faces the front or back side, and the four terminals of the first input/output end face different directions selected from the front or back side, the upper side, the down side, the left side, and the right side.

16. The compact assembly of claim 1, wherein the terminal of the second input/output end has a central symmetric cross sectional waveguide that supports dual polarizations.

17. The compact assembly of claim 1, the first and second ports of the OMT each have a generally rectangular shape, and the third port of the OMT has a generally square or circular shape.

18. The compact assembly of claim 1, wherein the OMT is configured to combine the two electromagnetic signals each having a single polarization mode from the polarization switch and the through transmission line into the electromagnetic signal having dual polarized modes, or split the electromagnetic signal having dual polarized modes from the terminal of the second input/output end into the two electromagnetic signals each having a single polarization mode.

19. The compact assembly of claim 1, wherein one of the two electromagnetic signals operates independently of each other.

20. The compact assembly of claim 1, wherein the compact assembly consists of three blocks connected to each other, each of the blocks defines cavities on one or more major surfaces thereof to form the terminals at the first and second ends, the directional couplers, the OMT, the polarization switcher, and the through transmission line.

21. A microwave communications system, comprising:

the compact assembly of claim 1;

a microwave antenna connected to the terminal at the second input/output end; and four outdoor units respectively connected to the four terminals at the first input/output end.

* * * * *